US010775038B2

(12) United States Patent
Abrahamsson

(10) Patent No.: US 10,775,038 B2
(45) Date of Patent: Sep. 15, 2020

(54) METHOD AND DEVICE FOR PRODUCING A GASEOUS MEDIUM COMPRISING STEAM

(71) Applicant: Steamex Group Sverige AB, Bromma (SE)

(72) Inventor: Michael Abrahamsson, Vaxholm (SE)

(73) Assignee: Steamex Group Sverige AB, Bromma (SE)

( * ) Notice: Subject to any disclaimer, the term of this patent is extended or adjusted under 35 U.S.C. 154(b) by 241 days.

(21) Appl. No.: 15/941,353

(22) Filed: Mar. 30, 2018

(65) Prior Publication Data

US 2018/0224117 A1 Aug. 9, 2018

Related U.S. Application Data

(63) Continuation of application No. 14/855,765, filed on Sep. 16, 2015, now Pat. No. 10,006,626, which is a (Continued)

(30) Foreign Application Priority Data

Sep. 28, 2007 (SE) ..... 0702189

(51) Int. Cl.
*F22B 1/18* (2006.01)
*B08B 3/00* (2006.01)
(Continued)

(52) U.S. Cl.
CPC ..... *F22B 1/1853* (2013.01); *B08B 3/00* (2013.01); *B08B 9/032* (2013.01); *B08B 9/0327* (2013.01);
(Continued)

(58) Field of Classification Search
CPC ..... B08B 3/00; B08B 9/032; B08B 2230/01; B08B 9/0327; F22B 5/02; F22B 1/18; E21B 37/00; E21B 37/06
(Continued)

(56) References Cited

U.S. PATENT DOCUMENTS 2,961,005 A 11/1960 Ipsen
3,756,029 A 9/1973 Aguet
(Continued)

FOREIGN PATENT DOCUMENTS

DE 114510 C 10/1900
GB 773048 A 4/1957
(Continued)

OTHER PUBLICATIONS

Extended European Search issued in application No. PCT/SE2008/051052 dated Nov. 8, 2016; 9 pages.
(Continued)

*Primary Examiner* — Vivek K Shirsat
*Assistant Examiner* — Ko-Wei Lin
(74) *Attorney, Agent, or Firm* — Pearne & Gordon LLP

(57) ABSTRACT

The invention relates to a method for producing a gaseous medium comprising steam, said steam being produced from a first fluid medium separated from the exhaust gas from combustion of a fuel in a steam generating step, said fuel being provided for burning for providing energy for heating said first fluid medium, comprising the steps of mixing the steam thus produced with exhaust gas from combustion of said fuel; and supplying at least one chemical substance different from air and water to said steam and exhaust gas mixture. The invention also relates to a device for producing a gaseous medium comprising steam.

17 Claims, 4 Drawing Sheets

Related U.S. Application Data continuation of application No. 12/680,380, filed as application No. PCT/SE2008/051052 on Sep. 19, 2008, now abandoned.

(51) Int. Cl.
*B08B 9/032* (2006.01)
*F22B 5/02* (2006.01)
*F28C 3/06* (2006.01)

(52) U.S. Cl.
CPC ..... *F22B 1/18* (2013.01); *F22B 5/02* (2013.01); *F28C 3/06* (2013.01); *B08B 2230/01* (2013.01)

(58) Field of Classification Search
USPC ..... 122/18.1, 31.2, 35, 36, 31.1, 448.1
See application file for complete search history.

(56) References Cited

U.S. PATENT DOCUMENTS

| | | | |
|---|---|---|---|
| 3,980,137 | A | 9/1976 | Gray |
| 4,099,572 | A | 7/1978 | Vasilenko |
| 4,380,267 | A | 4/1983 | Fox |
| 4,397,356 | A | 8/1983 | Retallick |
| 4,442,898 | A | 4/1984 | Wyatt |
| 4,580,504 | A | 4/1986 | Beardmore |
| 4,678,039 | A | 7/1987 | Rivas |
| 5,054,279 | A | 10/1991 | Hines |
| 5,165,483 | A | 11/1992 | Fox |
| 6,773,555 | B1 | 8/2004 | Izutsu |
| 2004/0089456 | A1 | 5/2004 | Howorka |
| 2004/0168433 | A1 | 9/2004 | Nojima |
| 2006/0286493 | A1 | 12/2006 | Abrahamsson |
| 2009/0266545 | A1 | 10/2009 | Abrahamsson |
| 2011/0214624 | A1 | 9/2011 | Abrahamsson |

FOREIGN PATENT DOCUMENTS

| | | | |
|---|---|---|---|
| GB | 821467 | A | 10/1959 |
| GB | 1449483 | A | 9/1976 |
| WO | 9743581 | A1 | 11/1997 |
| WO | 2004005797 | A1 | 1/2004 |
| WO | 2005012818 | A1 | 2/2005 |
| WO | 2007038255 | A2 | 4/2007 |
| WO | 2007114775 | A2 | 10/2007 |
| WO | 2009041894 | A1 | 4/2009 |

OTHER PUBLICATIONS

EP Communication pursuant to Rule 164(1) EPC issued in application No. PCT/SE2007/050169, dated Jul. 23, 2015; 6 pages.

International Search Report and Written Opinion issued in International PCT Application No. PCT/SE2008/051052 dated Jan. 14, 2009; 12 pages.

International Search Report and Written Opinion issued in International PCT Application No. PCT/SE2007/050169 dated Sep. 13, 2017; 17 pages.

METHOD AND DEVICE FOR PRODUCING A GASEOUS MEDIUM COMPRISING STEAM

CROSS-REFERENCE TO RELATED APPLICATIONS

This application is a continuation of U.S. application Ser. No. 14/855,765, filed Sep. 16, 2015, which is a continuation of U.S. application Ser. No. 12/680,380, filed May 23, 2011, which is a national stage application of International Appl. PCT/SE2008/051052, filed Sep. 19, 2008, and which claims priority of Swedish Patent Appl. No. 0702189-2, filed Sep. 28, 2007, all of which are hereby incorporated by reference.

TECHNICAL FIELD

The present invention relates to a method for producing a gaseous medium comprising steam. The present invention also relates to a device for producing a gaseous medium comprising steam.

BACKGROUND ART

WO 2005/012818 discloses a method, a device and a system for heating by means of a gaseous medium comprising steam, said steam being produced from water, energy for heating the water being provided by burning a fuel, wherein the steam is mixed with exhaust gas from the combustion of said gaseous medium; and wherein said mixture is used for heating purposes, for e.g. cleaning and extracting oil. The mixture is also used for fire fighting.

OBJECTS OF THE INVENTION

An object of the present invention is to provide a method for producing a gaseous medium comprising steam which is efficient, especially for applications such as heating up cavities for cleaning, extracting oil, and for extinguishing fires.

Another object of the present invention is to provide a device for producing a gaseous medium comprising steam which is efficient, especially for applications such as heating up cavities for cleaning, extracting oil, and for extinguishing fires.

SUMMARY OF THE INVENTION

These and other objects, apparent from the following description, are achieved by a method and a device for producing a gaseous medium comprising steam, as described below. Preferred embodiments of the inventive methods, devices and systems are defined below.

Particularly these objects are, according to the present invention, achieved by a method for producing a gaseous medium comprising steam, said steam being produced from a first fluid medium separated from the exhaust gas from combustion of a fuel in a steam generating step, said fuel being provided for burning for providing energy for heating said first fluid medium, comprising the steps of mixing the steam thus produced with exhaust gas from combustion of said fuel; and supplying at least one chemical substance different from air and water to said steam and exhaust gas mixture. This improves the efficiency when using said steam and exhaust gas mixture for certain applications such as e.g. cleaning, extraction of oil, or extinguishing of fires.

According to one embodiment of the method said at least one chemical substance is supplied to the steam produced in the steam generating step prior to the step of mixing the steam with the exhaust gas. The effect of the injection of a chemical substance in the hot steam is that it is vaporised. When the steam is pressurised the disintegration of the chemical substance becomes more efficient.

Thus, the exhaust gas is mixed with a steam comprising chemical substance. In use the mixture of the steam comprising the vaporised chemical substance, when introduced into a cavity, due to the properties of the steam and the high temperature of the mixture fills the cavity rapidly and e.g. melts and dissolves soot, oil or the like, or extinguishes a fire, depending on application. Compared to using non-vaporised chemical substance, the amount of chemical substance needed is drastically reduced.

According to one embodiment the method comprises the step of supplying a fluid medium to the steam produced in the steam generating step prior to the step of mixing the steam with the exhaust gas. By introducing a fluid a higher volume/amount of steam is achieved, and a mixture of steam comprising at least one chemical substance and exhaust gas having a higher fluid, e.g. water, content and a lower temperature, compared to no fluid, e.g. water, injection is further achieved. As a consequence of the fluid injection the dew point of the mixture is increased substantially. Thus, by varying the amount of fluid injected into the primary chamber the dew point may be varied. Having a high dew point in the mixture offers the advantage that the mixture can "carry" the energy a further distance, as there is a higher fluid, e.g. water, content in the mixture. The steam mixed with the exhaust gas is thus saturated with vaporised fluid, e.g. water, i.e. the relative humidity of the steam is increased significantly by means of injecting and vaporising fluid into the steam. The efficiency is thus increased. By injecting the fluid, e.g. water, as a mist preferably having a droplet size of less than 10 microns further increases the efficiency, as the fluid is vaporised more efficiently.

According to one embodiment of the method said at least one chemical substance is supplied to the fluid medium prior to the step of supplying the fluid medium to the steam.

According to one embodiment of the method the at least one chemical substance has properties suitable for extinguishing fires, such as oxygen removing properties. This provides for an efficient way of extinguishing fires, by means of said mixture.

According to one embodiment of the method the at least one chemical substance has dissolving properties suitable for, for example cleaning and/or extraction of oil. This provides for an efficient way of cleaning and/or extracting oil by means of said mixture.

According to one embodiment the method comprises the step of preheating the fluid medium separated from the steam generating step, energy for preheating the fluid medium being provided by said fuel. This facilitates providing a more efficient use of said fuel due to more efficient heat transfer as a consequence of a greater temperature difference.

According to one embodiment of the method the fluid medium in the preheating step is the first fluid medium. It is easier to use the same medium, and using the same medium facilitates mixing of same medium, e.g. steamed water and hot water.

According to one embodiment of the method said fluid medium from the preheating step is supplied to the steam generating step. In this way hot fluid is provided to be used for steam production, making the steam production more efficient.

According to one embodiment of the method said fluid medium from the preheating step is supplied to the steam produced in the steam generating step, preferably as a mist having a droplet size in the range of microns, preferably less than 10 microns. The reduction in temperature of the mixture is minimized due to the fact that the fluid, e.g. water is preheated prior to being injected into the steam. Thus the vaporisation of the injected fluid becomes more efficient due to the preheating of said fluid. The efficiency is thus further increased due to the preheating of the fluid injected into the steam prior to the mixing step. By injecting the fluid, e.g. water, as a mist preferably having a droplet size of less than 10 microns further increases the efficiency, as the fluid is vaporised more efficiently.

According to one embodiment of the method the steam in the steam generating step is provided under pressure. Providing steam under pressure provides for the steam to bring the exhaust gas at a certain speed in connection with the steam and exhaust gas mixing step, such that the mixture easily may be introduced into a e.g. a cavity. Due to the fact that the steam is pressurised, the preheated fluid introduced is, by means of the pressurised steam, i.e. the flow rate of the steam, disintegrated and vaporised, i.e. the disintegration of the fluid introduced into steam becomes more efficient.

According to one embodiment the method comprises the step of burning said fuel in a combustion space. This facilitates a controlled way of burning the fuel.

According to one embodiment the method comprises the step of introducing air into said combustion space. This provides for a continued combustion.

According to one embodiment the method comprises the step of preheating said air prior to introducing it into the combustion space, energy for preheating the air being provided by said fuel. This increases the efficiency.

According to one embodiment the method comprises the step of compressing said air prior to introducing said air into the combustion space. The air thus has a higher pressure such that when ignited the exhaust gas thus provided has a high velocity.

According to one embodiment of the method a fluid medium, not being a fuel, is supplied, preferably injected as a mist having a droplet size in the range of microns, preferably less than 10 microns, into the air in the air introduction step upstream of the combustion space, such that the fluid medium is mixed with the air. Thereby a more efficient cooling is achieved. Further the density of the air is increased and hence the evaporation force during combustion.

According to one embodiment of the method the fluid medium is water. Water, and thus steam produced thereof is a suitable medium for applications such as extinguishing fires, cleaning and extracting oil. Further, water is easily accessible, cheap, environmental friendly and safe to handle.

Theses objects are, according to the present invention, also achieved by a device for producing a gaseous medium comprising steam, said device comprising a combustion space and means for burning a fuel in said combustion space, said steam being arranged to be produced by means of a steam production means from a first fluid medium separated from the exhaust gas from combustion of said fuel, said fuel being provided for burning for providing energy for heating said first fluid medium, said device comprising a mixing space for mixing the steam thus produced with exhaust gas from combustion of said fuel, and an outlet for discharging said mixture, comprising chemical substance supply means for supplying at least one chemical substance different from air and water to said steam and exhaust gas mixture. This improves the efficiency when using said steam and exhaust gas mixture for certain applications such as e.g. cleaning, extraction of oil, or extinguishing of fires.

According to one embodiment the device further comprises steam supply means for supplying steam to the mixing space arranged upstream of said mixing space, wherein said chemical substance is arranged to be supplied from said chemical substance supply means to said steam supply means. The effect of the injection of a chemical substance in the hot steam is that it is vaporised. When the steam is pressurised the disintegration of the chemical substance becomes more efficient. Thus, the exhaust gas is mixed with a steam comprising chemical substance. In use the mixture of the steam comprising the vaporised chemical substance, when introduced into a cavity, due to the properties of the steam and the high temperature of the mixture fills the cavity rapidly and e.g. melts and dissolves soot, oil or the like, or extinguish a fire, depending on application. Compared to using non-vaporised chemical substance, the amount of chemical substance needed is drastically reduced.

According to one embodiment the device further comprises a fluid supply means for supplying a fluid to the steam supply means. By introducing a fluid a higher volume/amount of steam is achieved, and a mixture of steam comprising at least one chemical substance and exhaust gas having a higher fluid, e.g. water, content and a lower temperature, compared to no fluid, e.g. water, injection is further achieved. As a consequence of the fluid injection the dew point of the mixture is increased substantially. Thus, by varying the amount of fluid injected into the primary chamber the dew point may be varied. Having a high dew point in the mixture offers the advantage that the mixture can "carry" the energy a further distance, as there is a higher fluid, e.g. water, content in the mixture. The steam mixed with the exhaust gas is thus saturated with vaporised fluid, e.g. water, i.e. the relative humidity of the steam is increased significantly by means of injecting and vaporising fluid into the steam. The efficiency is thus increased. By injecting the fluid, e.g. water, as a mist preferably having a droplet size of less than 10 microns further increases the efficiency, as the fluid is vaporised more efficiently.

According to one embodiment of the device said chemical substance is arranged to be supplied from said chemical substance supply means to said fluid supply means.

According to one embodiment of the device the at least one chemical substance has properties suitable for extinguishing fires, such as oxygen removing properties. This provides for an efficient way of extinguishing fires, by means of said mixture.

According to one embodiment of the device the at least one chemical substance has dissolving properties suitable for, for example cleaning and/or extraction of oil. This provides for an efficient way of cleaning and/or extracting oil by means of said mixture.

According to one embodiment the device further comprises preheating means for preheating a fluid medium separately from the steam production means, energy for preheating the fluid medium being provided by said fuel. This facilitates providing a more efficient use of said fuel due to more efficient heat transfer as a consequence of a greater temperature difference.

According to one embodiment of the device the fluid medium arranged to be preheated is the first fluid medium. It is easier to use the same medium, and using the same medium facilitates mixing of same medium, e.g. steamed water and hot water.

According to one embodiment of the device said preheating means comprises passing means for passing the fluid medium for preheating. This facilitates passing the fluid when it is preheated.

According to one embodiment of the device the steam production means comprises a fluid transport means for transporting the first fluid medium, wherein the preheated fluid medium is arranged to be passed from the passing means into the fluid transport means. In this way hot fluid is provided to be used for steam production, making the steam production more efficient.

According to one embodiment of the device the preheated fluid medium is arranged to be supplied from the passing means to and introduced into the steam supply means, preferably as a mist having a droplet size in the range of microns, preferably less than 10 microns. The reduction in temperature of the mixture is minimized due to the fact that the fluid, e.g. water is preheated prior to being injected into the steam. Thus the vaporisation of the injected fluid becomes more efficient due to the preheating of said fluid. The efficiency is thus further increased due to the preheating of the fluid injected into the steam prior to the mixing step. By injecting the fluid, e.g. water, as a mist preferably having a droplet size of less than 10 microns further increases the efficiency, as the fluid is vaporised more efficiently.

According to one embodiment of the device heat for preheating said fluid medium is provided from said combustion space. This provides an efficient way of preheating the fluid medium.

According to one embodiment of the device said passing means comprises a jacket of the combustion space. This facilitates an efficient way of preheating the fluid medium while passed, which provides for a simple design and easy construction.

According to one embodiment of the device the steam supply means further comprises a pressure chamber for pressurising the steam, arranged upstream of the mixing chamber. The pressure chamber facilitates for the steam to bring the exhaust gas at a certain speed in connection with the steam and exhaust gas being mixed in the mixing space, such that the mixture easily may be introduced into a e.g. a cavity. Due to the fact that the steam is pressurised, the preheated fluid intended to be introduced is, by means of the pressurised steam, i.e. the flow rate of the steam, disintegrated and vaporised, i.e. the disintegration of the fluid introduced into steam becomes more efficient.

According to one embodiment the device further comprises means for introducing air into the combustion space. This provides for a continued combustion.

According to one embodiment the device further comprises means for preheating the air prior to being introduced into the combustion space, energy for preheating the air being provided by said fuel. This increases the efficiency of the device.

According to one embodiment the device further comprises means for compressing the air, said means being arranged upstream of said combustion space. The air thus has a higher pressure such that when ignited the exhaust gas thus provided has a high velocity.

According to one embodiment the device further comprises turbine means arranged to drive said compressor means by means of a portion of the exhaust gas and air. This is an efficient way of driving the compressor means.

According to one embodiment the device further comprises a constriction means, for example a convergent nozzle, arranged to accelerate the exhaust gas and air towards the outlet. This further increases the efficiency.

According to one embodiment of the device a fluid medium not being a fuel, preferably water, is arranged to be introduced into the air upstream of the combustion space, preferably as a mist having a droplet size in the range of microns, such that the fluid is mixed with the air. Thereby a more efficient cooling is achieved. Further the density of the air is increased and hence the evaporation force during combustion.

According to one embodiment of the device the fluid medium is water. Water, and thus steam produced thereof is a suitable medium for applications such as extinguishing fires, cleaning and extracting oil. Further, water is easily accessible, cheap, environmental friendly and safe to handle.

BRIEF DESCRIPTION OF THE DRAWINGS

A better understanding of the present invention will be had upon the reference to the following detailed description when read in conjunction with the accompanying drawings, wherein like reference characters refer to like parts throughout the several views, and in which.

DETAILED DESCRIPTION

Figure 1:
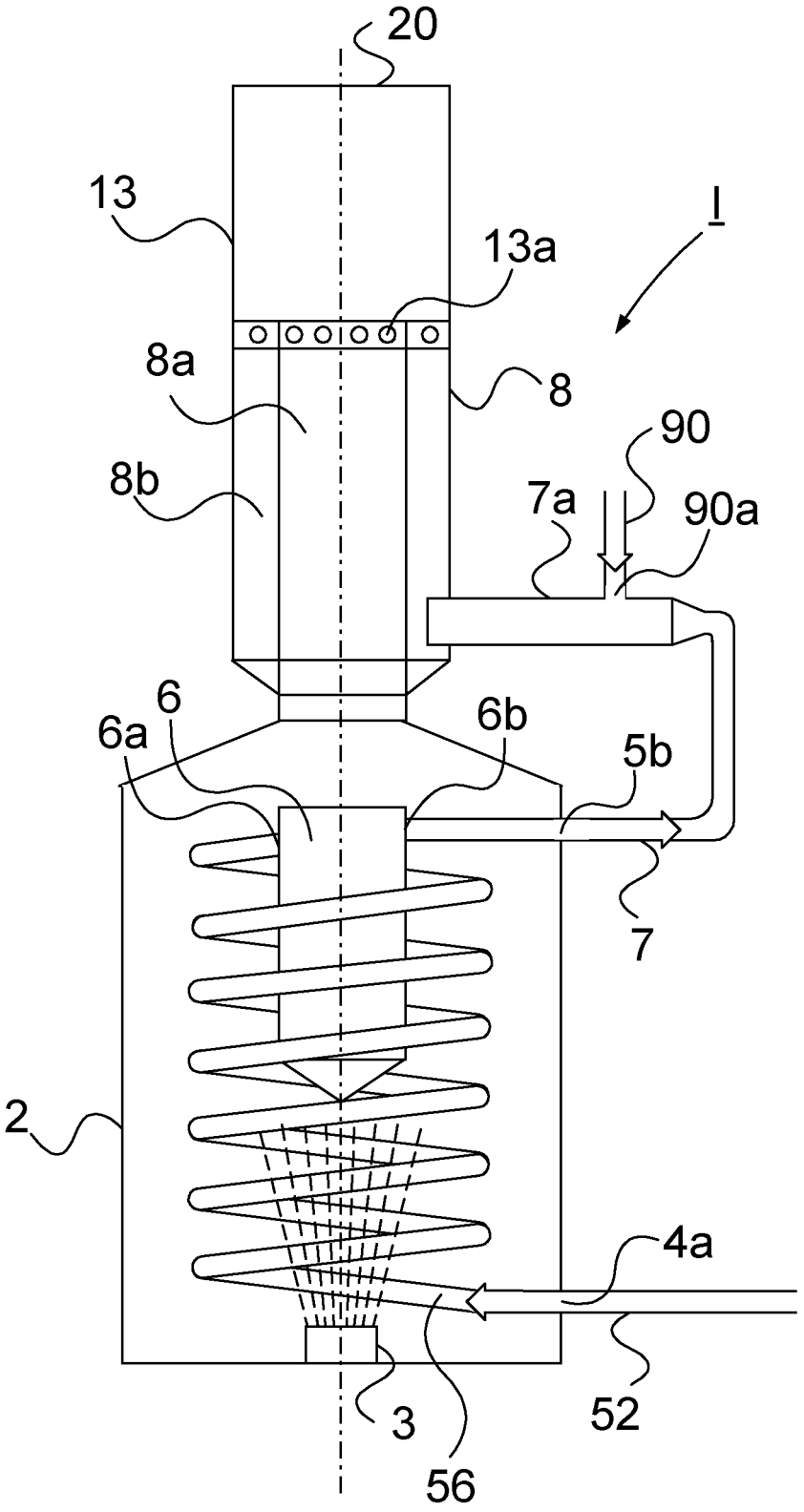
FIG. 1 schematically shows an elevational view of a device for efficient energy transformation by means of a gaseous medium comprising steam according to a first embodiment of the present invention.

FIG. 1 schematically shows an elevational view in cross section of a device for efficient energy transformation by means of a gaseous medium comprising steam according to a first embodiment of the present invention.

The device I comprises a combustion chamber 2, means for burning a fuel such as a burner 3 for burning said fuel, e.g. a gas burner 3, attached to the bottom of said chamber 2, for introducing heat into said chamber 2. The chamber 2 comprises a first fluid inlet **4*a* at a lower portion of the chamber 2 for introducing a fluid, e.g. water into the chamber 2, via a first fluid transport means 52, e.g. a first pipe 52. The fluid is arranged to be transported within the chamber 2 by means of a third fluid transport means 56, e.g. a third pipe configuration 56, such that it is heated by means of the heating means 3. The third fluid means, e.g. said third pipe 56, preferably has a helical shape, i.e. constituting a coil 56, rising upwardly in the combustion chamber 2. The coil 56 is arranged within the combustion chamber 2 such that it substantially surrounds the flame of the burning means 3**. In this way the fluid is heated from the heat from burning the fuel in an efficient way with minimum heat losses.

The device I further comprises a pressure chamber 6 arranged within the chamber 2, in an upper portion. The pressure chamber 6 comprises an inlet **6*a* for introducing fluid, e.g. water, preferably arranged in the upper portion thereof. The pipe configuration 56 is connected to the inlet 6*a* of the pressure chamber 6 such that fluid flowing in the pipe 56 is introduced into the pressure chamber 6. The pressure chamber 6 further comprises an outlet 6***b* in the upper portion thereof, to which a fourth fluid transport means 7, e.g. a fourth pipe 7 is connected. The fourth pipe is arranged through a second outlet 5*b* in the chamber wall. An end portion of the pipe 7 constitutes a primary injection chamber 7*a*. The device further comprises a chemical substance supply means 90 for supplying a chemical substance connected to the primary chamber 7*a*. The primary injection chamber 7*a* comprises a second inlet 90*a* through which the fluid comprising a chemical substance different from water and air is intended to be supplied from the supply means 90 into the primary chamber 7*a*.

The device I further comprises a secondary injection chamber 8 having an inner cavity 8*a* and an outer cavity 8*b* preferably coaxially surrounding the inner cavity 8*a*, said chamber 8 being arranged such that exhaust gas from the combustion chamber 2 from burning said fuel is allowed into the inner cavity 8*a*, said secondary injection chamber 8 preferably being attached to the top of the chamber 2. The primary chamber 7*a* is connected to the outer cavity 8*b* of the secondary injection chamber 8. Steam from said primary chamber 7*a* is intended to be introduced into the outer cavity 8*b* of the injection chamber 8 via openings. In an embodiment the openings have a nozzle like configuration. The exhaust gas is, as mentioned, arranged to be introduced into the inner part 8*a* of the injection chamber 8.

The device further comprises a mixing chamber 13 constituting the downstream part of the injection chamber, where steam, via nozzle like holes/openings 13*a* in the tube dividing the inner cavity 8*a* and the outer cavity 8*b* of the injection chamber 8, is intended to be introduced from the outer cavity 8*b* of the injection chamber 8. Steam comprising at least one chemical substance and exhaust gases are thus intended to be mixed in the mixing chamber such that a steam, chemical substance and exhaust gas mixture is achieved. The device further comprises an outlet 20 for discharging the steamex.

When operating the device using water as fluid, water is introduced through the first pipe 52 into the third pipe configuration 56 via the first inlet 4*a*. The water is transported in the third pipe 56, where it is preheated by means of the means for burning a fuel, i.e. the burner 3. The third pipe configuration 56 is configured such that heated water remains liquid as it reaches the pressure chamber 2, and/or the flow rate of the water in the third pipe configuration is regulated such that the heated water therein remains liquid as it reaches the pressure chamber 6. The heated water thus then enters the pressure chamber 6 through the inlet 6*b*, where it is pressurised to a suitable high pressure. The pressurised steam, the steam having a pressure of e.g. 3-10 Bar depending on regulation means and design, leaves the pressure chamber 6 through the outlet 6*b* and continues through the pipe 7 via a valve means (not shown) and enters the primary chamber 7*a*.

The steam and the chemical substance are mixed in the primary chamber 7*a*, such that a mixture of the steam and the chemical substance having a slightly lower temperature, e.g. approximately 120-170° C., than the temperature of the steam introduced from the pressure chamber 6. Due to the fact that the steam in the primary chamber 7*a* is pressurised, the chemical substance/substances introduced is/are, by means of the pressurised steam, i.e. the flow rate of the steam, disintegrated and vaporised. According to an aspect, the chemical substance is sprayed into the primary chamber by e.g. a nozzle configuration.

The mixture of steam and chemical substance is introduced/flows into the outer cavity 8*b* of the secondary injection chamber 8 and flows towards the mixing chamber 13. As the mixture of steam and chemical substance flows in the outer cavity 8*b* it is heated by means of the exhaust gas flowing in the inner cavity 8*a* of the injection chamber 8 towards the mixing chamber 13, the exhaust gas having a temperature of e.g. approximately 400-800° C. depending on regulation and design. The steam comprising chemical substance is heated by means of the exhaust gas to a temperature of e.g. 300-450° C., depending on design, exhaust gas temperature etc., and consequently expands correspondingly. As the hot mixture of steam and chemical substance enters the mixing chamber 13, it will due to the expansion have a high flow rate.

The mixture of steam and chemical substance enters the mixing chamber through nozzle like holes/openings 13*a* in the inner tube dividing the inner and outer cavities. The mixture of steam and chemical substance having, a high flow rate, is mixing with the exhaust gas creating a mixture of steam, chemical substance and exhaust gas. The holes 13*a* are configured such that an ejector effect is achieved as the mixture of steam and chemical substance projects through the same. The ejection has the effect that the mixture of steam and chemical substance lifts the exhaust gases or brings the exhaust gases with the mixture of steam and chemical substance as they mix, i.e. has a jet suction effect. A depression is thus created such that the combustion continues, i.e. the burning of the fuel is not extinguished. The mixing chamber 13 has a larger cross sectional area than the inner cavity 8*a*, preferably a cross sectional area corresponding to the sum of the cross sectional area of the inner and outer cavity 8*a*, 8*b*.

Other fluids than water, with different properties having the same or different densities may be used, depending on application.

According to one embodiment the chemical substance has properties suitable for extinguishing fires, and may comprise substances comprising salts. The chemical substance/substances have for example oxygen removing properties.

According to another embodiment the chemical substance has properties suitable for cleaning, in spaces such as kitchen ducts. The chemical substance/substances have for example fat soluble properties.

According to yet another embodiment the chemical substance has properties suitable for extinguishing oil. The chemical substance/substances have for example oil soluble properties.

The effect of the injection of a chemical substance in the hot pressurised steam in is that it is disintegrated and vaporised. Thus, the exhaust gas is mixed with a steam comprising chemical substance. In use the mixture of the steam comprising the vaporised chemical substance, when introduced into a cavity, due to the properties of the steam and the high temperature of the mixture fills the cavity rapidly and e.g. melts and dissolves soot, oil or the like, or extinguish a fire, depending on application.

Figure 2:
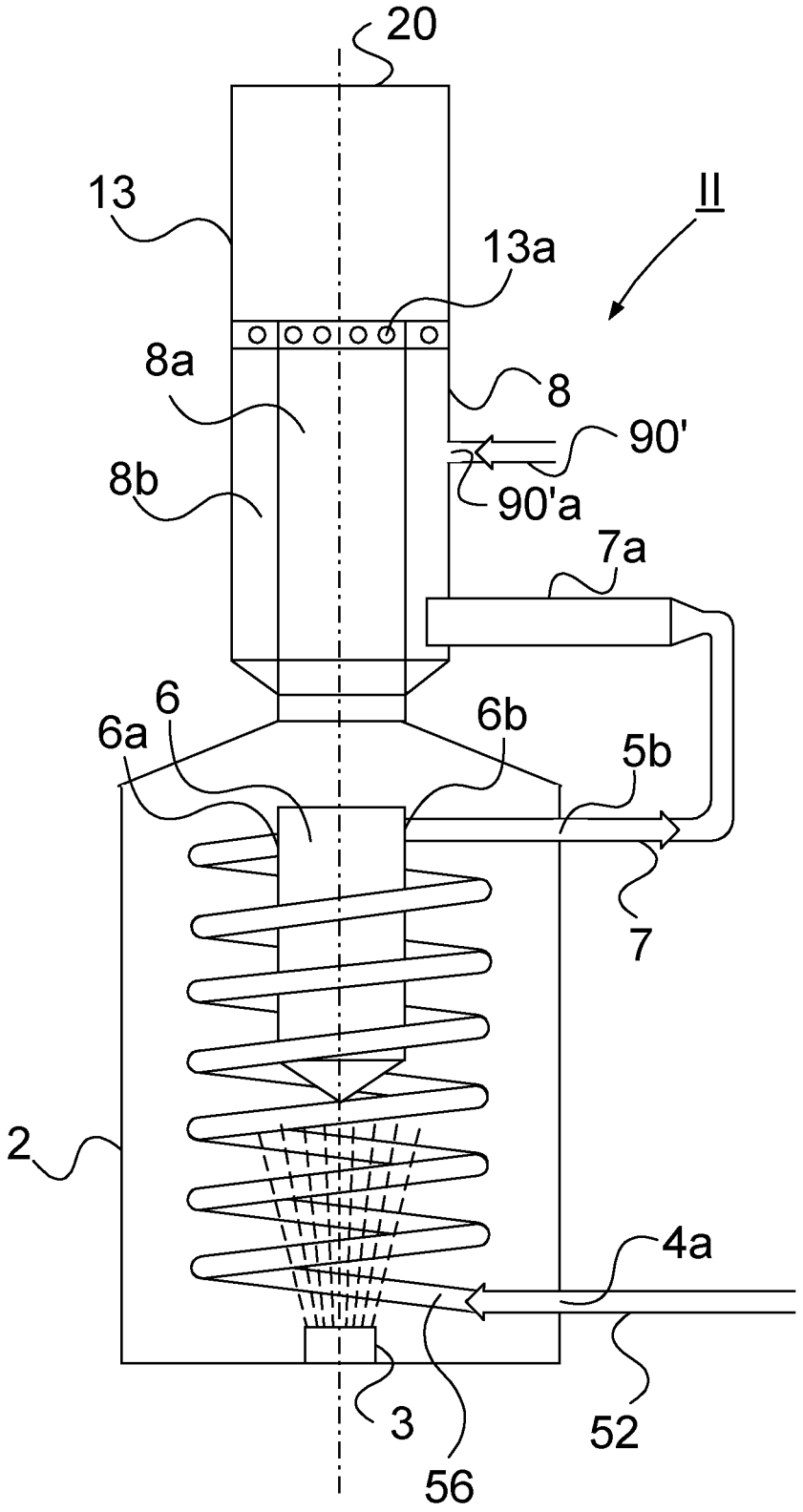
FIG. 2 schematically shows a perspective view of a device for efficient energy transformation by means of a gaseous medium comprising steam according to a third embodiment of the present invention.

FIG. 2 schematically shows an elevational view in cross section of a device II for efficient energy transformation by means of a gaseous medium comprising steam according to a second embodiment of the present invention. The second embodiment according to FIG. 2 differs from the first embodiment in that the chemical substance is arranged to be introduced into the outer cavity 8*b*, where it is mixed with the steam introduced into the same from the primary chamber 7*a*.

As the steam, when present in/passing the outer cavity 8*b* of the secondary chamber 8, is substantially no longer pressurised, the disintegration effect of the injected chemical substance/substances directly into the steam in the outer cavity 8*b* is less as compared to the disintegration effect when introduced into the primary chamber 7*a*.

Possible applications regarding the mixture of steam comprising chemical substance and exhaust gas are explained in FIG. 1 with regard to the first embodiment.

Figure 3:
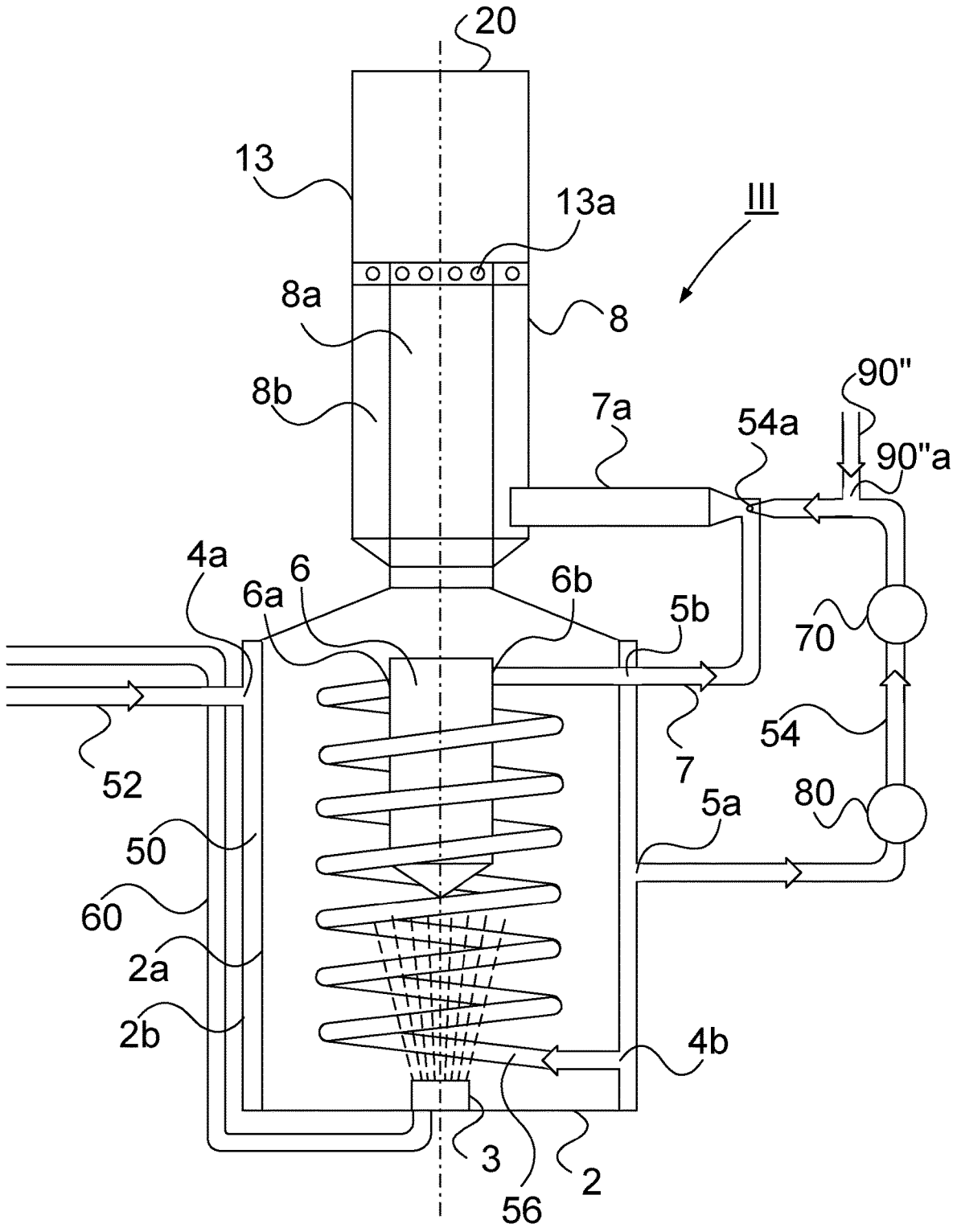
FIG. 3 schematically shows a perspective view of a device for efficient energy transformation by means of a gaseous medium comprising steam according to a second embodiment of the present invention.

FIG. 3 schematically shows an elevational view in cross section of a device III for efficient energy transformation by means of a gaseous medium comprising steam according to a third embodiment of the present invention.

The device III comprises a combustion chamber 2, means for burning a fuel such as a burner 3 for burning said fuel, e.g. a gas burner 3, attached to the bottom of said chamber 2, for introducing heat into said chamber 2. The chamber has an inner wall 2*a* and an outer wall 2*b*, said walls forming a fluid jacket 50. The chamber 2 comprises a first fluid inlet 4*a* according to an embodiment arranged at an upper portion of the outer wall 2*b*, for introducing a fluid, e.g. water into the jacket 50, i.e. into the space formed between the inner wall 2*a* and the outer wall 2*b*, via a first fluid transport means 52, e.g. a first pipe 52. The chamber 2 further comprises a first outlet 5*a* arranged at the outer wall 2*b*, for discharging fluid from the jacket into a second fluid transport means 54, e.g. a second pipe 54.

The chamber 2 further comprises a second inlet 4*b* arranged at the inner wall 2*a*, for discharging fluid from the jacket into third fluid transport means 56, e.g. a third pipe configuration 56. The fluid is arranged to be transported within the chamber 2 by means of the third fluid transport means 56 such that it is heated by means of the heating means 3. The third fluid means, e.g. said third pipe configuration 56, preferably has a helical shape, i.e. constituting a coil 56, rising upwardly in the combustion chamber 2. The coil 56 is arranged within the combustion chamber 2 such that it substantially surrounds the flame of the burning means 3. In this way the fluid is heated from the heat from burning the fuel in an efficient way with minimum losses.

The device III further comprises a pressure chamber 6 arranged within the chamber 2, in an upper portion. The pressure chamber 6 comprises an inlet 6a for introducing fluid, e.g. water, preferably arranged in the upper portion thereof.

The pipe configuration 56 is connected to the inlet 6*a* of the pressure chamber 6 such that fluid flowing in the pipe 56 is introduced into the pressure chamber 6. The pressure chamber 6 is arranged within the combustion chamber such that the fluid therein is efficiently heated into steam. The pressure chamber 6 is arranged to pressurise the steam therein. The pressure chamber 6 further comprises an outlet 6*b* in the upper portion thereof, to which a fourth fluid transport means 7, e.g. a fourth pipe 7 is connected. The fourth pipe is arranged through a second outlet 5*b* in the chamber wall. An end portion of the pipe 7 constitutes a primary injection chamber 7*a* into which a fluid, e.g. water is intended to be injected. Steam is thus intended to be extracted from the pressure chamber 6, the pressure chamber 6 being arranged upstream of the primary chamber 7*a* such that pressurised steam is arranged to be supplied to the primary chamber 7*a*.

The device III further comprises a fluid supply means 90" for supplying a chemical substance, connected to the second fluid transport means 54. The fluid transport means 54 comprises an inlet 90"*a* through which the fluid comprising a chemical substance different from water and air is intended to be supplied into the fluid transport means 54 where it is intended to mix with the hot water therein.

The second pipe 54 is connected to the primary chamber 7*a*. The second pipe 54 has a nozzle 54*a* at the end arranged such that, when fluid, such as water and a chemical substance, is arranged to be discharged there through, it is sprayed into the primary chamber 7*a*. The mixture of hot water and the chemical substance is thus arranged to be sprayed into the primary chamber 7*a* such that it is mixed with the steam.

An effect of introducing the chemical substance into the second fluid transport means 54 is that it is preheated by means of the hot fluid, e.g. water, therein prior to being introduced into the primary chamber 7*a*.

The device further comprises a secondary injection chamber 8 having an inner cavity 8*a* and an outer cavity preferably coaxially surrounding the inner cavity 8*a*, said chamber 8 being attached to the top of the chamber 2. The primary chamber 7*a* is connected to the outer cavity 8*b* of the secondary injection chamber 8. The steam comprising the chemical substance introduced from said primary chamber 7*a* is intended to be introduced into the outer cavity 8*b* of the injection chamber 8. The exhaust gas is intended to be introduced into the inner part 8*a* of the injection chamber 8.

The device III further comprises a mixing chamber 13 constituting the downstream part of the injection chamber, where steam, via nozzle like holes/openings 13*a* in the tube dividing the inner cavity 8*a* and the outer cavity 8*b* of the injection chamber 8, is intended to be introduced from the outer cavity 8*b* of the injection chamber 8. The steam comprising chemical substance/substances is thus intended to be mixed in the mixing chamber with exhaust gases such that a steam, chemical substance and exhaust gas mixture is achieved. The device further comprises an outlet 20 for discharging said mixture.

The device III further comprises an air transport means 60 or air supply means 60. The air transport means is arranged in connection to the combustion chamber 2 such that heat provided by means of burning said fuel heats said air. The air transport means is connected to the means 3 for burning said fuel, e.g. said burner 3 such that hot air is supplied to the burner 3. Thus, according to the embodiment of FIG. 1 air is heated by the radiation from the combustion chamber 2 by means of burning said fuel, the air thus being preheated separated from the air in the combustion chamber 2. This increases the efficiency of the device. According to this embodiment the air transport means is externally arranged relative to the combustion chamber. Alternatively the air transport means is partly internally arranged relative to the combustion chamber 2.

When operating the device using water as fluid, water is introduced through the first pipe 52 into the jacket 50. The water introduced into the jacket 50 is preheated by means of heat provided by the burning means 3. The preheated water is flowing from the jacket 50 through the second inlet 4*b* into the third pipe 56, where it is preheated further by means of the burning means 3. The third pipe configuration 56 is configured such that heated water remains liquid as it reaches the pressure chamber, and/or the flow rate of the water in the third pipe configuration is regulated such that the heated water therein remains liquid as it reaches the pressure chamber 6. The heated water thus then enters the pressure chamber 6 through the inlet 6*b*, where it is vaporised and pressurised to a suitable high pressure. The pressurised steam, the steam having a pressure of e.g. 3-10 Bar, leaves the pressure chamber 6 through the outlet 6*b* and continues through the pipe 7 via a safety valve means (not shown) and enters the primary chamber 7*a*.

The device further comprises means for regulating the temperature of the fluid in the second pipe 54, for example a temperature regulator 70 arranged to regulate the temperature of the fluid, e.g. water, in the second pipe 54.

The device III further comprises means for regulating the flow rate of the fluid in the second pipe 54, for example a flow regulator 80, valve means or the like.

The preheated water in the jacket 50 is also discharged from the jacket 50 through the first outlet 5*a* into the second pipe 54. The chemical substance different from water and air is introduced/injected into the preheated water in the second pipe 54. Water together with the chemical substance from the second pipe 54 is continuously introduced and sprayed into the primary chamber 7*a* via the nozzle 54*a*. Preferably the nozzle is configured such that the water comprising chemical substance exiting the nozzle is a mist having a droplet size in the range of microns, preferably less than 10 microns. The steam in the pipe 7 is, due to preheating in the jacket, preheating in the third pipe 56, and heating in the pressure chamber, e.g. approximately 140-180° C. As the water is preheated in the jacket 50, a higher efficiency is achieved and thus a higher temperature of the steam entering the primary injection chamber 7*a* is achieved than had the water introduced in the third pipe been cold water. The water and chemical substance sprayed into the primary chamber is e.g. approximately 50-80° C. due to the preheating in the jacket 50.

The steam and the mist of water and chemical substance are mixed in the primary chamber 7*a*, such that a steam of slightly lower temperature, but with a higher content of water is achieved. Due to the fact that the steam in the primary chamber 7*a* is pressurised, the water comprising the chemical substance/substances introduced is, by means of the pressurised steam, i.e. the flow rate of the steam, disintegrated and vaporised. The flow rate is thus increased, due to the injected mist of water and chemical substance, the flow rate depending on the amount of water injected. As an example the flow rate may increase from e.g. approximately 10 $m^3$/min at about 150-160° C. to e.g. approximately 20 $m^3$/min at about 130-140° C. Due to the preheating in the jacket 50 the temperature of the steam containing the mist of water and chemical substance is increased in comparison to cold water in the second pipe 54 and the third pipe 56.

The steam with high water content comprising a chemical substance is introduced/flows into the outer cavity 8*b* of the secondary injection chamber 8 and flows towards the mixing chamber 13. As the steam flows in the outer cavity 8*b* it is heated by means of the exhaust gas flowing in the inner cavity 8*a* of the injection chamber 8 towards the mixing chamber 13, the exhaust gas having a temperature of e.g. approximately 400-800° C., depending on e.g. design. The steam comprising the chemical substance is heated by means of the exhaust gas to a temperature of e.g. 250-400° C., depending on e.g. design, exhaust gas temperature, amount of water injected into the primary chamber 7*a* etc., and consequently expands correspondingly. As the hot steam enters the mixing chamber it will due to the expansion have a high flow rate.

The steam comprising the chemical substance enters the mixing chamber through nozzle like holes/openings 13*a* in the inner tube dividing the inner and outer cavities. The steam comprising the chemical substance having, a high flow rate, is mixing with the exhaust gas creating a steam, chemical substance and exhaust gas mixture. The holes 13*a* are configured such that an ejector effect is achieved as the steam projects through the same. The ejection has the effect that the steam lifts the exhaust gases or brings the exhaust gases with the steam and chemical substance as they mix, i.e. has a jet suction effect. A depression is thus created such that the combustion continues, i.e. the burning of the fuel is not extinguished. The mixing chamber 13 has a larger cross sectional area than the inner cavity 8*a*, preferably a cross sectional area corresponding to the sum of the cross sectional area of the inner cavity 8*a* and outer cavity 8*b*.

Other fluids than water, with different properties having the same or different densities may be used, depending on application.

The effect of the water injection, or rather injection of water mist of less than 10 microns, into the primary chamber 7*a* is that a higher volume/amount of steam is achieved, and a mixture of steam, chemical substance and exhaust gas having a higher water content, e.g. about 96% instead of e.g. about 83% without water injection and a lower temperature without water injection. The reduction in temperature is, due to the preheating of the water by means of heat radiation from the combustion chamber 2 prior to injecting it into the primary chamber 7*a* less compared to injection of cold water.

As a consequence of the water injection the dew point is increased a lot. By injecting cold water mist into the steam in the primary chamber 7*a* the dew point is increased to e.g. to about 86-92° C. instead of e.g. about 65-68° C. without water injection. The dew point is further increased due to the preheating of the water in the jacket 50 prior to injection, and a dew point close to 100° C. is achievable due to the effect of introducing preheated water mist into the steam. The temperature of the water flowing in the second pipe 54 is regulated by means of the temperature regulator 70. The flow rate of the water flowing in the second pipe is regulated by means of the flow regulator 80. Thus, by varying the amount of water mist injected into the primary chamber the dew point may be varied. Further, by varying the temperature of the mist of water and chemical substance injected into the primary chamber 7*a* the dew point may be varied. Having a high dew point in the mixture of steam, chemical substance and exhaust gas offers the advantage that the mixture can "carry" the energy a further distance, as there is a higher water content in the mixture. The steam mixed with the exhaust gas is thus saturated with vaporised water, i.e. the relative humidity of the steam is increased significantly by means of injecting, vaporising and disintegrating hot water. The efficiency of the device is thus increased due to the water and chemical substance mist injection. The efficiency is further increased due to preheating of the water prior to injection into the primary chamber 7*a*.

The supply of chemical substance different from water and air has advantages in applications such as fire extinguishing, oil extraction and cleaning as explained above in relation to the first embodiment.

Figure 4:
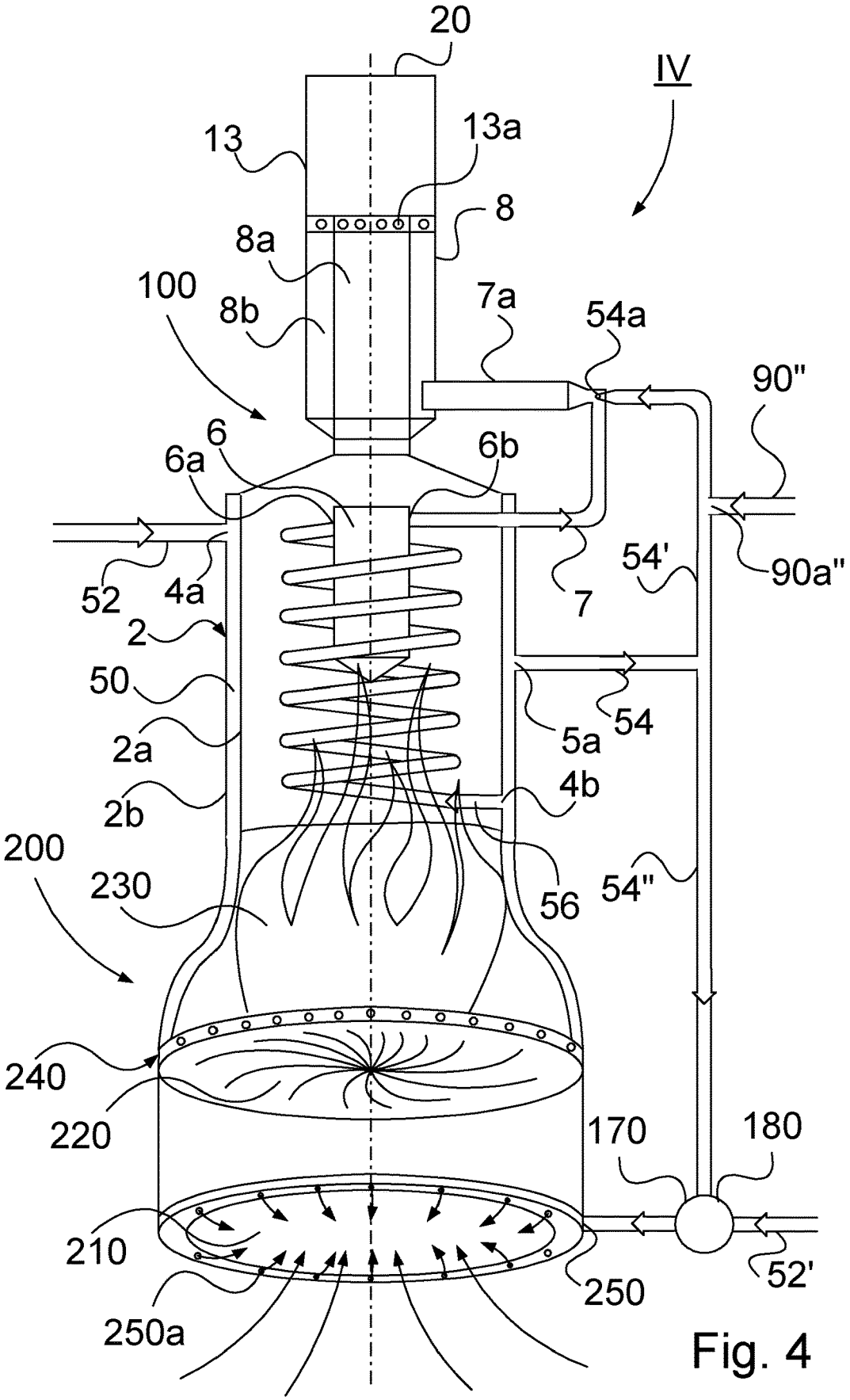
FIG. 4 schematically shows a perspective view of a device for efficient energy transformation by means of a gaseous medium comprising steam according to a fourth embodiment of the present invention.

FIG. 4 schematically shows a perspective view of a device IV for efficient energy transformation by means of a gaseous medium comprising steam according to a fourth embodiment of the present invention. The device IV according to the fourth embodiment is substantially a combination of a gas turbine or the like and the device according to the third embodiment, as will be explained below.

The device IV according to the fourth embodiment of the present invention comprises a gas turbine part 200 and a steam/chemical substance/exhaust gas mixture generator part 100. The gas turbine part comprises an air inlet 210, means 220 for sucking air into the gas turbine part such as a fan 220 preferably arranged downstream of the air inlet, a combustion chamber 230 or similar space/cavity, and means for combusting a fuel within said combustion chamber 230, said fuel preferably being arranged to be introduced into the combustion chamber via fuel inlet means 240. Preferably the gas turbine part comprises compressor means arranged to compress the air sucked in through the air inlet 210. Preferably the gas turbine part comprises a turbine means, e.g. a turbine wheel, arranged to drive said compressor means by means of a portion of the exhaust gas and air produced in the combustion chamber. Preferably the device comprises a constriction means, e.g. a convergent nozzle or the like, arranged to receive the exhaust gas and air, for accelerating said exhaust gas and air through the same in order to increase the flow rate.

The gas turbine part 200 could be any kind of gas turbine having any design suitable for producing exhaust gas of high flow rate, the gas turbine being adaptable with the device according to the first embodiment, or similar device intended to produce a steam, chemical substance and exhaust gas mixture. In other words the means for burning the fuel which in FIG. 1 as an example is constituted by a burner 3, here may comprise ignition means in a gas turbine, such that a high flow rate of the exhaust gas produced is achieved. Instead of sucking the air into the air inlet by suction means, an alternative way of introducing air is to blow the air into said air inlet by blowing means.

The generator part 100 comprises a heating chamber 2. The chamber has an inner wall 2*a* and an outer wall 2*b*, said walls forming a fluid jacket 50. The jacket 50 is also arranged to surround the combustion chamber portion 230 of the device IV. The chamber comprises a first fluid inlet 4*a* arranged at an upper portion of the outer wall 2*b*, for introducing a fluid, e.g. water into the jacket 50, i.e. into the space formed between the inner wall 2*a* and the outer wall 2*b*, via a first fluid transport means, e.g. a first pipe 52. The chamber 2 further comprises a first outlet 5*a* arranged at the outer wall 2*b*, for discharging fluid from the jacket into a second fluid transport means 54, e.g. a second pipe 54.

The chamber 2 further comprises a second inlet 4*b* arranged at the inner wall 2*a*, for discharging fluid from the jacket into third fluid transport means 56, e.g. a third pipe 56. The fluid is arranged to be transported within the chamber 2 by means of the third fluid transport means 56 such that it is heated by means of the heating means 3. The third fluid transport means 56, e.g. said third pipe 56, preferably has a helical shape, i.e. constituting a coil 56, rising upwardly in the combustion chamber 2. The coil 56 is arranged within the combustion chamber 2 such that it substantially surrounds the flame of the burning means 3. In this way the fluid is heated from the heat from burning the fuel in an efficient way with minimum losses.

The device IV further comprises a pressure chamber 6 arranged within the chamber 2, in an upper portion. The pipe configuration 56 is connected to an upper portion of the pressure chamber 6. Fluid, e.g. water is intended into the pressure chamber 6 through an inlet 6*a*, to be introduced and boiled. The pressure chamber 6 further comprises an outlet 6*b* in the upper portion thereof, to which a fourth fluid transport means 7, e.g. a fourth pipe 7 is connected. The fourth pipe is arranged through a second outlet 5*b* in the chamber wall. An end portion of the pipe 7 constitutes a primary injection chamber 7*a* into which a fluid, e.g. water is intended to be injected.

The second pipe 54 is connected to the primary chamber 7*a* via a first branch pipe 54'. The branch pipe 54' has a nozzle 54*a* at the end arranged such that, when fluid, such as water preheated in the jacket 50, is arranged to be discharged there through, it is sprayed into the primary chamber 7*a*.

The device further comprises a fluid supply means 90" for supplying a chemical substance, connected to the first branch pipe 54' of the second fluid transport means 54. The first branch pipe 54' comprises an inlet 90"*a* through which the fluid comprising a chemical substance different from water and air is intended to be supplied into the first branch pipe 54' of the fluid transport means 54 where it is intended to be transported with the hot water therein.

The device further comprises a secondary injection chamber 8 having an inner cavity 8*a* and an outer cavity preferably coaxially surrounding the inner cavity 8*a*, said chamber 8 being attached to the top of the chamber 2. The primary chamber 7*a* is connected to the outer cavity 8*b* of the secondary injection chamber 8. Steam comprising the chemical substance is intended to be introduced from said primary chamber 7*a* into the outer cavity 8*b* of the injection chamber 8 via the pipe 7. The exhaust gas is intended to be introduced into the inner part 8*a* of the injection chamber 8.

The device further comprises a mixing chamber 13 constituting the downstream part of the injection chamber, where steam comprising chemical substance, via nozzle like holes/openings 13*a* in the tube dividing the inner cavity 8*a* and the outer cavity 8*b* of the injection chamber 8, is intended to be introduced from the outer cavity 8*b* of the injection chamber 8. Steam comprising chemical substance and exhaust gases are thus intended to be mixed in the mixing chamber such that a steam, chemical substance and exhaust gas mixture is achieved. The device further comprises an outlet 20 for discharging the mixture.

The generator part 100 of the device is arranged downstream of the combustion chamber 230 such that the heat from the burning fuel in the combustion chamber heats up the pipe configuration 56 in the chamber 2, into which pipe 56 a fluid, e.g. water is intended to be introduced and flow. The exhaust gas is intended to be introduced into the inner part 8*a* of the injection chamber 8.

The second pipe 54 is also connected, via a temperature regulation means 170, to a third fluid inlet 250 arranged at a lower portion of the turbine part 200 via a second branch pipe 54". The device further comprises a fifth fluid transport means 52' for transporting a cold fluid medium, for example cold water, said fifth fluid transport means 52' being connected to the third fluid inlet 250. The fifth fluid transport means 52' may be fed from the same source as the first fluid means 52, or a different source. Through the third fluid inlet 250 preferably fluid, e.g. water, more preferably fluid mist, e.g. water mist, having a droplet size in the range of microns, preferably less than 10 microns, is arranged to be introduced into the turbine part 200. According to an embodiment the water is sprayed into the air inlet 210, via the third fluid inlet 250, through openings/nozzles 250*a*, preferably arranged circumferentially about the air inlet 210. The temperature of the fluid introduced into the third fluid inlet 250 is arranged to be regulated by means of the temperature regulation means 170. The third fluid inlet 250 is preferably located at the air inlet 210 side of the turbine part 200, such that the mist is mixed with the air. The fluid mist of less than 10 microns is e.g. accomplished by means of a nozzle. As the density of the air, e.g. the water content in the air, is increased the evaporation force is increased during combustion. Preferably the air is arranged to be filtered prior to entering the turbine part. The device further comprises flow regulation means 180 for regulating the flow rate of the fluid medium introduced into the third fluid inlet 250.

It is preferred that the temperature of the fluid mist, e.g. water mist, introduced into the third inlet 250 is cold, e.g. in the range of 2-8° C. In this way the air, for example having room temperature, introduced into the air inlet is efficiently cooled, i.e. an air cooler effect is achieved. In order to prevent the temperature in the combustion chamber 230 to exceed a certain value, the working temperature in the combustion chamber 230 of the turbine part is arranged to be controlled by means of the temperature regulation means 170, such that the temperature in the combustion chamber 230 does not exceed e.g. 1200° C.

By means of the flow regulation means 180, regulating the flow rate of the fluid, e.g. water introduced into the air in the air inlet 210, the combustion temperature is controlled. With a higher flow rate of the introduced water the efficiency is increased, as the more air/water is provided through by means of the turbine part, and the higher flow rate at the same timer results in a reduction in combustion temperature due to higher amount of water. Due to the water injection in the air the relative humidity in the combustion air is increased.

When operated, air is continuously introduced, e.g. sucked, into the turbine part 200 through the air inlet 210 by means of e.g. the fan 220. The air is heated in the combustion chamber 230 by means of burning means, such that the air expands. The gas of exhaust gas and air is directed towards the mixing chamber 13 at a high velocity. Preferably the air is compressed by means of compressor means after having been introduced into the air inlet 210, giving the air a higher pressure. Preferably fuel is injected through the fuel inlet 240 and mixed with the compressed air and is ignited by ignition means internally, i.e. in the combustion chamber 230. Substantially all of the air is heated and expands rapidly. It is exhausted as a high velocity gas, i.e. exhaust gas and air, preferably through a constriction means, for example a convergent nozzle. Preferably at least a portion of the gas is directed towards a turbine means, e.g. a blade of a turbine wheel, the energy created being used to drive the compressor means, the remaining portion being directed towards the mixing chamber 13.

When operating the device using water as fluid, water is introduced through the first pipe 52 into the jacket 50. The water introduced into the jacket 50 is preheated by means of heat provided by burning the fuel in the combustion chamber 230. The preheated water is flowing from the jacket 50 through the second inlet 4*b* into the third pipe 56, where it is preheated further by means of the fuel in the combustion chamber 230. The heated water and/or steam, then enters the pressure chamber 6 through the inlet 6*b*, where it is pressurised to a suitable high pressure. The pressurised steam, the steam having a pressure of e.g. 3-10 Bar, leaves the pressure chamber 6 through the outlet 6*b* and continues through the pipe 7 via the valve and enters the primary chamber 7*a*.

The steam and the water mist comprising the chemical substance are mixed in the primary chamber 7*a*, such that a steam of slightly lower temperature, e.g. approximately 130-170° C., but with a higher content of water is achieved. The flow rate is thus increased, due to the injected water mist, the flow rate depending on the amount of water injected. As an example the flow rate may increase from e.g. approximately 10 $m^3$/min at about 150-160° C. to e.g. approximately 20 $m^3$/min at about 130-140° C. Due to the preheating in the jacket 50 the temperature of the steam containing the water mist comprising chemical substance is increased in comparison to providing cold water of e.g. 6° C. in the second pipe 54 and the third pipe 56.

The steam with high water content comprising chemical substance is introduced/flows into the outer cavity 8*b* of the secondary injection chamber 8 and flows towards the mixing chamber 13. As the steam comprising chemical substance flows in the outer cavity 8*b* it is heated by means of the exhaust gas flowing in the inner cavity 8*a* of the injection chamber 8 towards the mixing chamber 13, the exhaust gas having a temperature of e.g. approximately 400-800° C., depending e.g. on design and dimensions. The steam comprising chemical substance is heated by means of the exhaust gas to a temperature of e.g. about 250-400° C., and consequently expands correspondingly. As the hot steam comprising chemical substance enters the mixing chamber it will due to the expansion have a high flow rate.

The effect of the water injection, or rather injection of water mist of less than 10 microns, into the primary chamber 7*a* is that a higher volume/amount of steam is achieved, and a mixture of steam and exhaust gas comprising chemical substance having a higher water content, e.g. about 96% instead of e.g. about 83% without water injection and a lower temperature, e.g. 250-400° C. instead of e.g. 300-450° C. without water injection, depending on e.g. design, dimensions, flow rate of injected water etc. The relative humidity of the steam is thus increased. The reduction in temperature is, due to the preheating of the water by means of heat radiation from the combustion chamber 2 prior to injecting it.

As a consequence of the water injection the dew point is increased a lot. By injecting cold water mist into the steam in the primary chamber 7*a* the dew point is increased to e.g. to about 86-92° C. instead of e.g. about 65-68° C. without water injection. The dew point is further increased due to the preheating of the water in the jacket 50 prior to injection, and a dew point close to 100° C. is achievable. The temperature of the water flowing in the second pipe is regulated by temperature regulation means. The flow rate of the water flowing in the second pipe is regulated by flow regulation means. Thus, by varying the amount of water mist injected into the primary chamber the dew point may be varied. Further, by varying the temperature of the water mist injected into the primary chamber 7*a* the dew point may be varied. Having a high dew point in the mixture of steam comprising chemical substance, and exhaust gas offers the advantage that the mixture can "carry" the energy a further distance, as there is a higher water content in the mixture.

The water injected at the third fluid inlet 250 is thus preheated by means of the burning fuel in the combustion chamber 230. The effect of mixing preheated water mist, instead of cold water mist, introduced into the third fluid inlet 250 with air is that the efficiency is increased. The water may be fed from the same source as the water/steam fed to and injected into the primary injection chamber 7*a* and the inlet 4*a* into the chamber 2 of the mixture generator part 100, or water may be fed from separate sources. Preferably there are control means in order to control the flow of water to the inlets 4*a*, 250 and to the primary chamber 7*a*.

By means of the gas turbine part, exhaust gas at high pressure/high flow rate is produced, which facilitates transporting the steam comprising chemical substance and exhaust gas mixture long distances at high velocity/high pressure, where due to the high dew point of the mixture, i.e. the high water content in the hot mixture, the energy content is preserved, i.e. energy losses are reduced. Due to the high pressure and high flow rate achieved, the device facilitates filling up large cavities in short time.

There are applications where the above effects are advantageous. For example the device may advantageously be used for extinguishing fires in coal mines by means of the steam and exhaust gas mixture of high flow rate/pressure and high water content/dew point. According to another example the device may be used for extracting oil in oil sand under ground, where the steam comprising chemical substance and exhaust gas mixture due to the high energy content, i.e. the high dew point/high water content and high flow rate may be transported further.

Instead of a gas turbine or gas turbine like device, any kind of means for achieving a high flow rate of exhaust gas for heating steam and be mixed by said steam may be used, such as e.g. a gas generator or the like.

In the fourth embodiment of FIG. 4 the steam, chemical substance and exhaust gas mixture generator part 100 is similar to the third embodiment according to FIG. 3 apart from the burning means, which according to the fourth embodiment is achieved by means of the turbine part 200, i.e. a turbine configuration, and in the third embodiment by a burner 3. A generator part according to the second and third embodiments of FIGS. 2 and 3 may alternatively be used in connection with the turbine part 200 of the device according to the embodiment of FIG. 4.

A difference between the device I, II, III according to the first, second and third embodiment and the device IV according to the fourth embodiment is the following. In the device I, II, III according to the first, second and third embodiment the steam in the secondary chamber 8 having a certain flow rate directed towards the outlet 20 is arranged to bring the exhaust gas through the outlet at a certain speed in connection with the steam and exhaust gas mixing step. In the device IV in the fourth embodiment the exhaust gas having, due to the turbine effect, a much higher flow rate than the steam is arranged to bring the steam through the outlet 20 at a certain higher speed in connection with the steam and exhaust gas mixing step. In the fourth embodiment the openings 13*a* are pressurised due to the high flow rate of the exhaust gas.

According to the invention, as described by the embodiments in FIG. 1-4, the steam is thus produced from a first fluid medium, e.g. water, separated from the exhaust gas from combustion of a fuel in the combustion chamber 2, in a steam generating step, said fuel being provided for burning for providing energy for heating said first fluid medium, wherein the steam is arranged to be mixed with the exhaust gas from combustion of said fuel in a mixing step. During the production of steam from the fluid, by means of heat from the fuel combusted in the combustion chamber, it is not in direct contact with the exhaust gas and/or the flame of the burning fuel. The steam is produced separated in a supply means, e.g. the third pipe configuration 56 and the pressure chamber 6. As the steam has been produced it is then mixed with the exhaust gas, in this example embodiment in the mixing chamber 13.

Where temperatures, pressures, efficiencies, flow rates and the like are mentioned they have been included for the purpose of increasing the intelligibility of the application and are only examples and do consequently not have any limiting effect on the interpretation of each element. These depend on e.g. the design of the device, the dimensions of the device, regulation means etc.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. A method for producing a gaseous medium comprising exhaust gas and steam, comprising:

combusting a fuel to generate heat and an exhaust gas having a temperature of 400-800° C.;

generating steam from a first fluid medium comprising water using the generated heat;

supplying an amount of second fluid medium comprising liquid water to the generated steam, whereby the second fluid medium is vaporized thus generating steam with increased water content;

heating the steam with increased water content to 250-400° C. by means of the exhaust gas; and mixing the heated steam with increased water content and the exhaust gas to create a mixture of exhaust gas and steam, wherein the amount of second fluid medium is varied to control the dew point of the mixture of exhaust gas and steam, and wherein the steam with increased water content and the exhaust gas are not mixed prior to the mixing step, and wherein the second fluid medium is supplied as a mist having droplet size of less than 10 microns.

2. The method according to claim 1, wherein the dew point of the mixture of exhaust gas and steam is more than 68° C.

3. The method according to claim 2, wherein the dew point of the mixture of exhaust gas and steam is at least 86° C.

4. The method according to claim 3, wherein the temperature of the mixture of exhaust gas and steam is 250-400° C.

5. The method according to claim 4, wherein the mixture of exhaust gas and steam is introduced into a space for cleaning purposes.

6. The method according to claim 1, wherein the temperature of the mixture of exhaust gas and steam is 250-400° C.

7. The method according to claim 6, wherein the mixture of exhaust gas and steam is introduced into a space for cleaning purposes.

8. The method according to claim 1, wherein the temperature of the steam with increased water content is less than 170° C.

9. The method according to claim 1, wherein the steam is pressurized at the time of supplying the second fluid medium.

10. The method according to claim 9, wherein the steam is pressurized to at least 3 bar.

11. The method according to claim 1, wherein the second fluid medium is preheated using the generated heat prior to supplying to the steam.

12. The method according to claim 11, wherein the second fluid medium is preheated to at least 50° C.

13. The method according to claim 1, wherein the second fluid medium further comprises a chemical substance different from air and water having dissolving properties suitable for cleaning.

14. The method according to claim 13, wherein the mixture of exhaust gas and steam is introduced into a space for cleaning purposes.

15. The method according to claim 14, wherein the temperature of the mixture of exhaust gas and steam is 250-400° C.

16. The method according to claim 15, wherein the dew point of the mixture of exhaust gas and steam is at least 86° C.

17. The method according to claim 1, wherein the mixture of exhaust gas and steam is introduced into a space for cleaning purposes.

* * * * *